US005121787A

United States Patent [19]

Corbett

[11] Patent Number: 5,121,787

[45] Date of Patent: Jun. 16, 1992

[54] EVAPORABLE FOAM PATTERN FOR CASTING A THERMOSTAT HOUSING FOR A V-TYPE MARINE ENGINE

[75] Inventor: William D. Corbett, Fond du Lac, Wis.

[73] Assignee: Brunswick Corporation, Skokie, Ill.

[21] Appl. No.: 643,335

[22] Filed: Jan. 22, 1991

[51] Int. Cl.[5] ..... B22C 7/02

[52] U.S. Cl. ..... 164/235; 164/34; 164/45; 164/246

[58] Field of Search ..... 164/235, 246, 249, 34, 164/35, 36, 45

[56] References Cited

U.S. PATENT DOCUMENTS

| | | | |
|---|---|---|---|
| 4,243,093 | 1/1981 | Nieman | 164/96 |
| 4,632,169 | 12/1986 | Osborn et al. | 164/45 |
| 4,640,333 | 2/1987 | Martin et al. | 164/246 |
| 4,657,063 | 4/1987 | Morris | 164/45 |
| 4,777,997 | 10/1988 | Corbett | 164/246 |
| 4,802,447 | 2/1989 | Corbett | 123/65 |
| 4,883,110 | 11/1989 | Morgan et al. | 164/249 |
| 4,907,638 | 3/1990 | Hubbell et al. | 164/45 |
| 4,951,733 | 8/1990 | Kusche et al. | 164/246 |
| 4,964,454 | 10/1990 | Hubbell et al. | 164/246 |
| 4,969,504 | 11/1990 | Ruhnke et al. | 164/235 |
| 4,987,945 | 1/1991 | Corbett | 164/235 |
| 5,031,685 | 7/1991 | VanRens | 164/249 X |
| 5,035,276 | 7/1991 | Corbett et al. | 164/249 X |
| 5,054,537 | 10/1991 | VanRens | 164/249 X |

FOREIGN PATENT DOCUMENTS

| | | |
|---|---|---|
| 25692225 | 2/1986 | France . |
| 52-29522 | 3/1977 | Japan . |
| 62-282763 | 12/1987 | Japan . |

OTHER PUBLICATIONS

Evaporative Foam Casting Technology Program, 1986, Buhr.

*Primary Examiner*—J. Reed Batten, Jr.

*Attorney, Agent, or Firm*—Andrus, Sceales, Starke & Sawall

[57] ABSTRACT

The pattern, composed of a polymeric material, is formed of three sections joined together by an adhesive along a pair of parallel parting lines. One parting line lies in a plane extending through the axis of an outlet to the engine block and through the axis of a sea water inlet, while the second parting line lies in a plane that extends through the axes of outlets leading to the exhaust manifolds of the V-engine. An inlet opening, through which coolant is received from the engine block, is located in one of the pattern sections and the axis of the inlet opening is normal to the parting lines.

12 Claims, 2 Drawing Sheets

EVAPORABLE FOAM PATTERN FOR CASTING A THERMOSTAT HOUSING FOR A V-TYPE MARINE ENGINE

BACKGROUND OF THE INVENTION

In a typical cooling system for a four-stroke V-type marine engine, cooling water is drawn from the engine block by a circulating pump and passes through a thermostat housing and is returned to the block, while fresh sea water is drawn to the thermostat housing by a sea water pick-up pump. When the thermostat is closed, the incoming sea water is mixed with the circulating cooling water in the thermostat housing and a portion of the mixed water is discharged through the exhaust elbows to overboard. When the thermostat valve is opened, a portion of the circulating water returned from the block is discharged through the exhaust manifolds to overboard.

With a cooling system of this type, the thermostat housing contains numerous ports or openings and internal chambers. For example, the housing is provided with a pair of inlet openings, one to receive water returned from the block, while the other receives incoming fresh sea water. In addition, the housing has an outlet communicating with the block circulating pump, a pair of outlets which communicate with the exhaust manifolds, and a second pair of outlets which are connected to the exhaust elbows. Further, the typical thermostat housing has a pair of holes for the pressure and temperature transducers. In the past, the thermostat housing has been sand cast from a ferrous metal and, due to the complexity of the housing configuration, the casting has been extremely complicated and expensive, requiring the use of extensive coring.

Evaporable foam casting procedures have been used for casting metal components of internal combustion engines, such as marine engines. In the typical evaporable foam process, a pattern is produced having a configuration identical to the metal part to be cast. The foam pattern is placed in a mold and a finely divided, unbonded material, such as sand, is placed around the pattern in the mold, and also fills the cavities in the mold. During casting, the molten metal will contact the evaporable foam pattern, causing the pattern to vaporize with the vapor being entrapped within the interstices of the sand, while the molten metal fills the void created by vaporization of the foam, thus resulting in a cast metal part which has a configuration identical to that of the foam pattern.

In some instances, evaporable foam casting enables a part to be cast as a single integral piece, thus eliminating the labor and material costs of connecting multiple cast parts to provide the final product.

In other situations, evaporable foam casting enables a part to be cast without the use of a complicated and expensive internal coring, and thus reduces the overall cost of the casting process.

SUMMARY OF THE INVENTION

The invention is directed to an evaporable foam pattern, formed of a material such as polystyrene or polymethylmethacrylate, which is used in casting a metal thermostat housing for a four stroke V-type marine engine. The housing pattern defines an inlet chamber which receives coolant from the block, and a manifold outlet chamber which communicates with the inlet chamber through an opening that seats a thermostat valve. A pair of outlets in the manifold outlet chamber communicate with the exhaust manifolds of the engine and supply coolant to the manifolds when the valve is open.

In addition, the housing pattern is provided with an outlet which is connected to the inlet chamber and provides communication with a circulating pump that serves to draw water from the outlet and circulate the water to the block. The housing pattern is also formed with a sea water inlet chamber having an inlet which receives incoming sea water, and a pair of outlets connect the sea water inlet chamber with the exhaust elbows of the engine. A bleed hole provides communication between the sea water inlet chamber and the outlet to the circulating pump for equalizing the flow.

In accordance with the invention, the evaporable foam housing pattern of the invention is composed of three separate pattern sections, having abutting surfaces which are joined together along two parting lines. A first of the parting lines extends through the inlet chamber, being normal to the axis of the inlet chamber, and the parting line splits the outlet to the circulating pump as well as the sea water inlet. The second parting line is parallel to the first parting line, extending transversely through the manifold outlet chamber, and the second parting line splits the outlets to the exhaust manifold.

With the use of the pattern of the invention, the entire thermostat housing can be cast as a single part by placing the parting lines in the position as described above. All of the internal chambers, as well as the openings in the housing, can be cast without the use of internal coring, as necessary in sand casting.

As a further advantage, the mounting holes which receive bolts to connect the thermostat housing to the engine block can be formed in the casting, thus eliminating the necessity of drilling holes in the cast housing as was required in the past.

The evaporable foam patten produces smooth, cylindrical bosses surrounding the inlets and outlets which facilitates the attachment of hoses to the cast housing.

Other objects and advantages will appear in the course of the following description.

DESCRIPTION OF THE DRAWINGS

The drawings illustrate the best mode presently contemplated of carrying out the invention.

DESCRIPTION OF THE ILLUSTRATED EMBODIMENT

Figure 1:
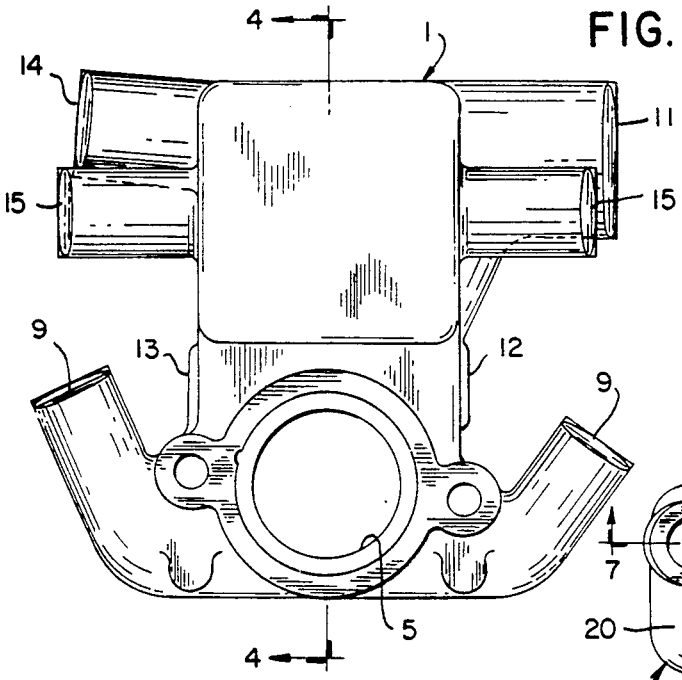
FIG. 1 is a plan view of the evaporable foam pattern used to cast the thermostat housing.

The drawings illustrate an evaporable foam pattern for use in casting a thermostat housing for a four-stroke marine engine, such as V-4 or V-6 engine. The pattern is formed of a polymeric material, such as polystyrene or polymethylmethacrylate, which is capable of vaporizing when exposed to the heat of a molten metal such as a ferrous alloy or aluminum alloy.

The housing pattern 1 has a configuration identical to the configuration of the cast metal housing, and therefore the description of the pattern will refer to the components of the cast housing.

Housing pattern 1 defines three chambers, an inlet chamber 2, a manifold outlet chamber 3 and a sea water inlet chamber 4. An inlet opening 5 is formed in housing pattern 1 and communicates with inlet chamber 2. When the cast housing is assembled with the engine block, water or other coolant is drawn from the engine block through inlet opening 5 to chamber 2 by a circulating pump.

An opening 6 provides communication between chambers 2 and 3, and the opening is bordered by an annular flange 7 which serves as a seat for a thermostat valve in the cast housing.

Housing pattern 1 is also provided with an opening 8 which communicates with chamber 3 and is axially aligned with opening 6. When the cast thermostat housing is assembled to the engine block, a cover, not shown, is bolted to the cast housing and encloses the opening 8.

Figure 6:
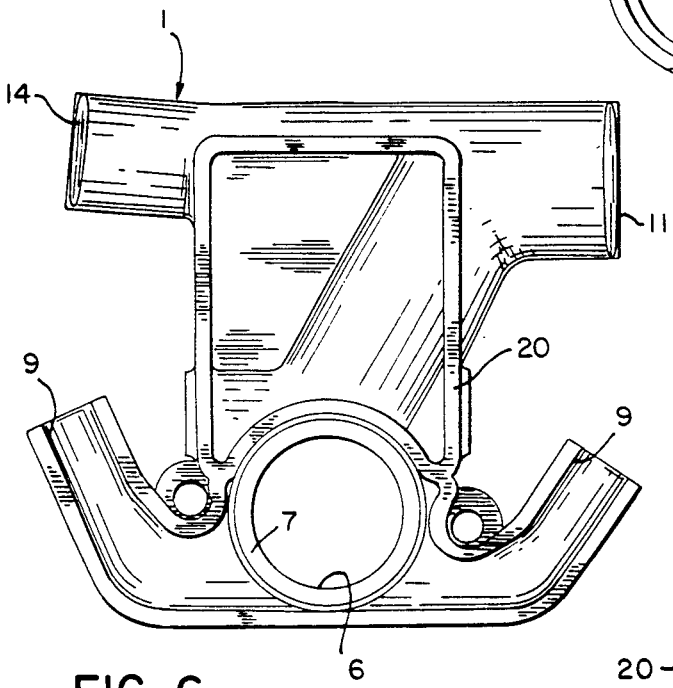
FIG. 6 is a section taken along line 6—6 of FIG. 2.
Figure 7:
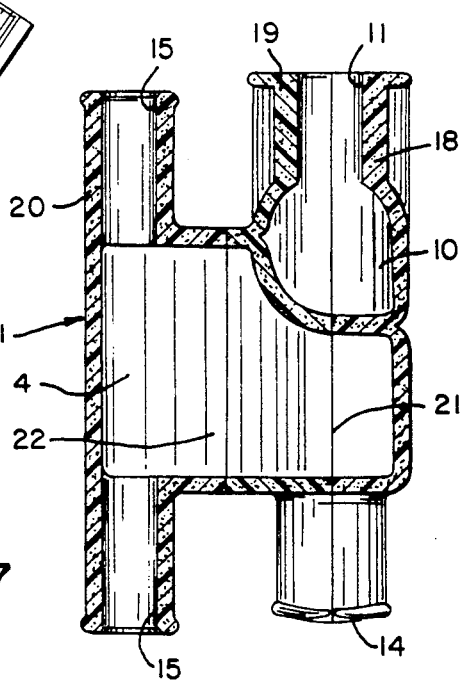
FIG. 7 is a section taken along line 7—7 of FIG. 2.

As best shown in FIG. 6, a pair of outlets 9 communicate with chamber 3 and, when the cast housing is assembled with the engine, each outlet 9 is connected through a hose to the exhaust manifold for a bank of cylinders of the V-type engine.

Figure 5:
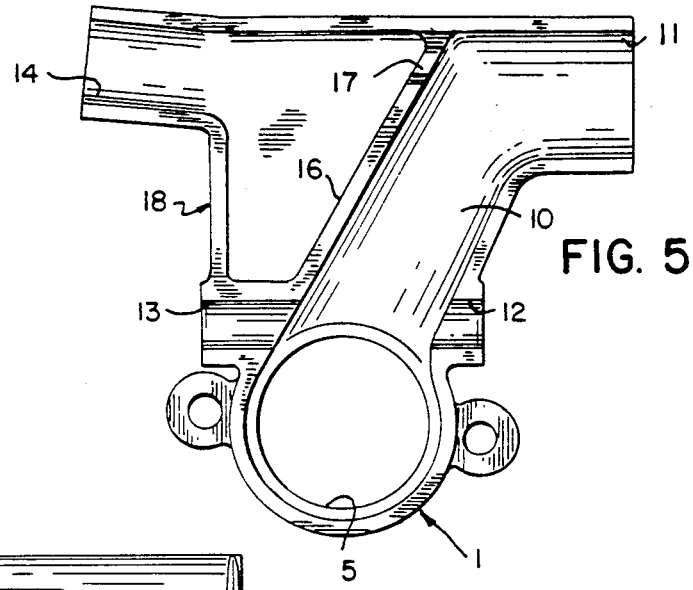
FIG. 5 is a section taken along line 5—5 of FIG. 2.

A generally radially extending passage 10 communicates with inlet chamber 2 and is connected to an outlet 11, as best shown in FIG. 5. When the cast housing is assembled with the engine block, the outlet 11 is connected through a hose or conduit to a circulating pump which circulates the coolant to the engine block. As previously noted, the coolant is returned from the block to the housing through opening 6 to inlet chamber 2.

Figure 2:
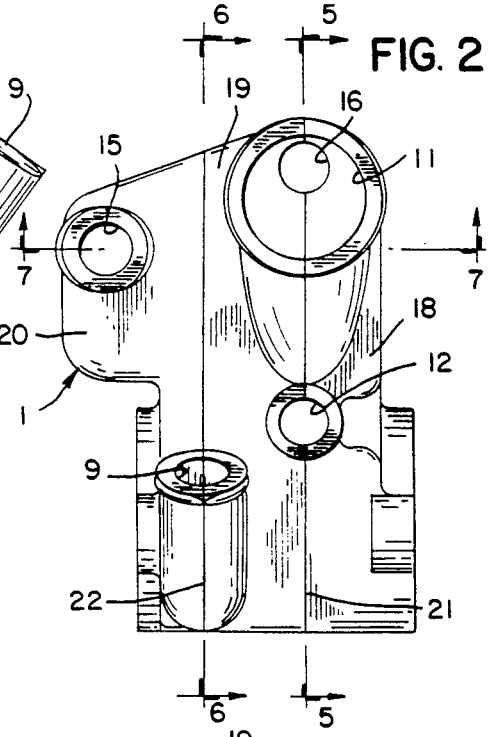
FIG. 2 is a right side view of the foam pattern shown in FIG. 1.
Figure 3:
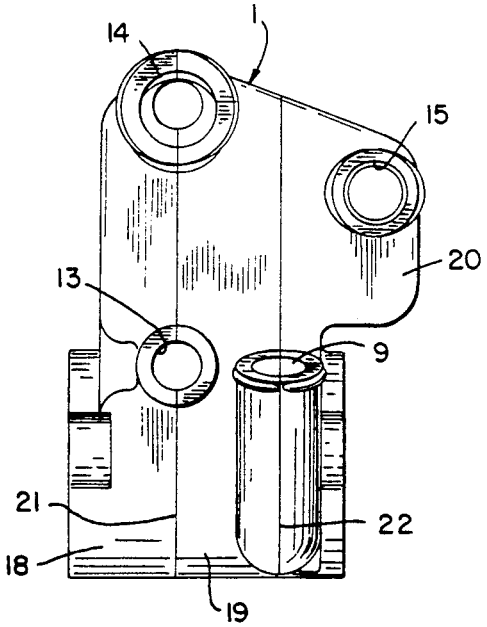
FIG. 3 is a left side view of the foam pattern.

Housing pattern 1 is also formed with a pair of openings 12 and 13, as shown in FIGS. 2, 3 and 5, and in the cast housing the openings 12 and 13 are tapped and receive a pressure and temperature transducer respectively. As seen in FIG. 5, the openings 12 and 13 are connected to the lower end of passage 10 adjacent to the inlet chamber 2.

Figure 4:
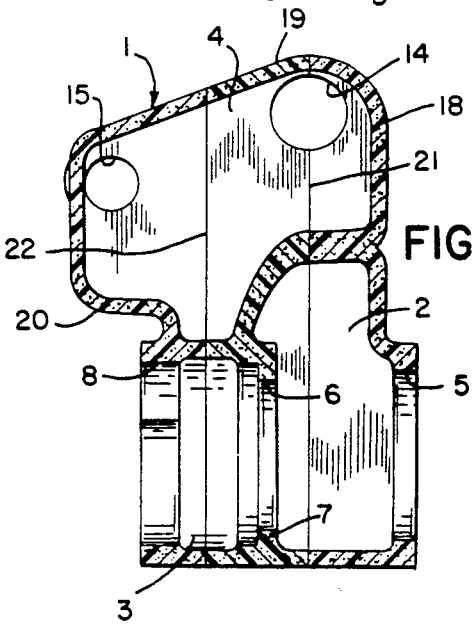
FIG. 4 is a section taken along line 4—4 of FIG. 1.

Chamber 4, as shown in FIG. 4, is located above chambers 2 and 3, and a sea water inlet 14 is connected to the upper portion of chamber 4 and serves to supply sea water to the chamber 4 in the cast housing through a separate sea water pick-up pump. In addition, a pair of outlets 15 communicate with chamber 4 and, when the cast housing is assembled with the engine block, the outlets 15 are connected via hoses to the exhaust elbows of the engine.

As illustrated in FIG. 5, a bleed hole 16 is formed in internal wall 17, which borders radial passage 10, and connects sea water inlet chamber 4 with the outlet 11 and serves to equalize the flow of the coolant.

In operation of the cooling system, the coolant will be drawn through the outlet 11 by the circulating pump and supplied to the engine block. The coolant will be returned to the thermostat housing through opening 6 and will then pass through the passage 10 to the outlet 11. In addition, sea water will be drawn into the housing through the inlet 14 and will be discharged through the outlets 15 to the exhaust elbows and then to overboard.

When the thermostat valve is open, a portion of the water being returned to the thermostat housing through inlet 5 will flow through the opening 6, and will be discharged through the outlets 9 to the exhaust manifolds, and then to overboard. In this situation, a portion of the sea water entering the housing through inlet 14 will pass through the bleed hole 16 to make up for the coolant which is discharged through the manifold to overboard.

In accordance with the invention, housing pattern 1 is formed of three pattern sections 18, 19 and 20. Pattern sections 18 and 19 have flat abutting surfaces which are joined together along a parting line indicated by 21. Similarly, pattern sections 19 and 20 have abutting surfaces which are joined together along a parting line 22.

The three pattern sections 18, 19 and 20 are joined or connected by an adhesive of the type commonly used in evaporable foam casting procedures. The adhesive is a type which will vaporize when exposed to the molten metal during casting, so that no adhesive residue will be present in the cast part.

Parting lines 21 and 22 are positioned in specific locations, as shown in FIGS. 2 and 4. Parting line 21 intersects inlet chamber 2 and is located normal to the axis of inlet opening 5. In addition, parting line 21 will split the outlet 11, holes 12 and 13, and the sea water inlet 14.

Parting line 22, which is parallel to parting line 21, passes through the chamber 3 and splits the outlets 9 as shown in FIG. 2.

With the use of the three pattern sections 18–20 and the location of the parting lines, the inlet opening 5, as well as the opening 8, are each located in a single pattern section. This ensures that the openings will be precisely formed to facilitate the connection of the inlet opening 5 to the engine block, and to facilitate the attachment of a cover plate to opening 8.

With the use of the evaporable foam pattern of the invention, the thermostat housing can be cast as an integral piece without the use of expensive coring as is required in normal sand casting techniques. Further, the openings 12 and 13, as well as the mounting holes for attachment of the cast housing to the engine block, can be cast directly in the housing, which eliminates the need for subsequently drilling holes as is necessary when utilizing sand casting procedures.

The cast housing produced through use of the pattern of the invention has smooth cylindrical bosses surrounding the inlet and outlet openings 9, 11, 14 and 15 which facilitates attachment of hoses to these openings.

Various modes of carrying out the invention are contemplated as being within the scope of the following claims particularly pointing out and distinctly claiming the subject matter which is regarded as the invention.

I claim:

1. An evaporable foam pattern for casting a thermostat housing for a four-stroke, V-type marine engine, comprising:

a housing pattern defining a first chamber, a second chamber and a third chamber;

first inlet means in said housing pattern and communicating with the first chamber for admitting a coolant from an engine block to the cast housing;

aperture means providing communication between said first and second chambers and bordered by an annular surface adapted to support a thermostat valve in the cast assembled housing;

outlet means communicating with said first chamber and adapted to discharge said coolant to the engine block;

a pair of first outlets each connected with the second chamber for discharging coolant;

a pair of second outlets communicating with the third chamber for discharging coolant;

second inlet means connected to the third chamber for supplying sea water to said third chamber;

port means providing communication between said third chamber and said outlet means;

the axes of said first outlets being disposed in a first plane and the axes of the second outlets being disposed in a second plane parallel to and offset from said first plane;

the axis of said inlet means and the axis of said outlet means disposed in a third plane parallel to and offset from said first and second planes;

said housing pattern composed of three pattern sections, including a first pattern section and a second pattern section having abutting surfaces disposed along a first parting line that lies in said second plane, said pattern also including a third pattern section, said second and third pattern sections having abutting surfaces disposed along a second parting line that lies in said first plane; and joining means for joining the abutting surfaces of said first and second pattern sections together and for joining the abutting surfaces of said second and said third pattern sections together.

2. The pattern of claim 1, wherein said first plane is disposed between said second and third planes.

3. The pattern of claim 1, wherein said first inlet means is disposed in said first pattern section.

4. The pattern of claim 3, wherein the axis of said first inlet means is disposed normal to said planes.

5. The pattern of claim 1, wherein said annular surface is disposed in said second pattern section.

6. The pattern of claim 1, wherein said second outlets are in said third pattern section.

7. The pattern of claim 1, wherein said outlet means includes a generally radially extending passage connected to said first inlet means, and an outlet connected to said radially extending passage.

8. The pattern of claim 1, wherein said abutting surfaces are flat surfaces.

9. The pattern of claim 8, wherein the axes of said first outlets are disposed at an angle to each other.

10. In an evaporable foam housing pattern for casting thermostat housing for a four-stroke, V-type marine engine, said housing pattern having a first inlet and a second inlet and an outlet disposed in communication with both of said inlets;

said housing pattern including a first pattern section and a second pattern section, said pattern sections having abutting surfaces disposed in a plane;

the axis of said second inlet and the axis of said outlet being located in said plane;

said plane disposed normal to the axis of said first inlet, and adhesive means for joining said abutting surfaces together.

11. The pattern of claim 10, wherein said housing pattern also includes a generally radially extending passage connecting said first inlet with said outlet, said housing pattern also having a hole providing communication between said radially extending passage and the exterior of said housing pattern, the axis of said hole disposed normal to the axis of said first inlet and disposed in said plane.

12. The pattern of claim 11, wherein said housing includes a bleed port providing communication between said second inlet and said radially extending passage.

* * * * *